United States Patent [19]

Cockrell, Jr. et al.

[11] Patent Number: 4,749,508

[45] Date of Patent: Jun. 7, 1988

[54] FLOOR CLEANING COMPOSITIONS AND THEIR USE

[75] Inventors: John R. Cockrell, Jr., Greensboro; Joseph T. Thekkekandam, Siler City, both of N.C.

[73] Assignee: Kay Chemical Company, Greensboro, N.C.

[21] Appl. No.: 763,733

[22] Filed: Aug. 8, 1985

Related U.S. Application Data

[63] Continuation-in-part of Ser. No. 698,468, Feb. 5, 1985, abandoned.

[51] Int. Cl.[4] ..... C11D 3/04

[52] U.S. Cl. ..... 252/136; 252/142; 252/79.1; 252/79.4; 134/40

[58] Field of Search ..... 252/136, 142, 79.1, 252/79.4; 134/40

[56] References Cited

U.S. PATENT DOCUMENTS 2,994,664 8/1961 Wachter ..... 252/87

*Primary Examiner*—Josephine Barr

*Attorney, Agent, or Firm*—Finnegan, Henderson, Farabow, Garrett & Dunner

[57] ABSTRACT

Acidic floor cleaning compositions are employed to improve the coefficient of static friction of floors, especially quarry tile, in environments conductive to the buildup of slippery-when-wet films, e.g., fast food restaurants. Such compositions, preferably buffered and containing surfactants, also improve the appearance of the floor by maintaining the floor free of ugly film without any significant attack on the grout or the tile.

24 Claims, No Drawings

FLOOR CLEANING COMPOSITIONS AND THEIR USE

CROSS REFERENCE TO RELATED APPLICATION

This is a continuation-in-part of application Ser. No. 698,468 filed Feb. 5, 1985, abandoned incorporated by reference herein.

TECHNICAL FIELD OF THE INVENTION

The present invention relates to novel floor cleaning compositions and methods of their use. The compositions are useful, in particular, for avoiding the occurrence of, for removing and for preventing the return of slippery-when-wet films, especially those comprised of: (a) animal and/or vegetable fats and fatty derivatives thereof, which are in a form hereinafter referred to as "polymerized", and (b) water-hardness minerals from, e.g., water, ceramic tile flooring, or even the organic film-forming material itself.

BACKGROUND OF THE INVENTION

For at least 30 years, proprietors of foodservice establishments have been plagued by an incessant slippery-when-wet condition of the flooring of such establishments. This condition is caused primarily by an undesirable film which forms on ceramic (quarry) tile flooring, and which has been extraordinarily difficult to remove. This unwanted wax-like, shiny, transparent film resists removal by conventional floor cleaning products, e.g., detergents, and procedures, e.g., scrubbing and mopping. Furthermore, the limited time and training allotted to floor cleaning procedures by foodservice establishments has unwittingly resulted in an increased build-up of these detergent-resistant films in many restaurants, thus creating a heightened demand for a means of safely removing the film.

The floor cleaning products and procedures currently employed leave many restaurant floors chronically coated with this detergent-resistant shiny film. A perception and belief that this film is a "soap" film has led to a reduction in the amount of detergent used (in an effort to reduce the "soap-film" problem); however, this technique has exacerbated the problem by permitting more rather than less grease to remain on the floor thereby resulting in an increased film buildup.

Not only is the detergent-resistant film undesirable from an aesthetic viewpoint, especially in connection with certain spots and splotches often found as part of the film, but of even greater importance is the fact that floors having this film display or exhibit greatly increased slipperiness when wet. This has resulted in both serious accidents and increased accident insurance premiums.

Whereas professional floor cleaning services have used an aqueous solution of hydrogen fluoride, e.g., 3–4 w/w %, to clean quarry tile, it is well known that dilute aqueous hydrogen fluoride is an exceptionally hazardous chemical. In other words, personnel normally working in foodservice establishments are not qualified to handle this toxic and corrosive chemical. (w/w % means weight percent per weight of solution.)

SUMMARY OF THE INVENTION

An object of one aspect of the invention is to provide floor cleaning compositions which preclude the occurrence of, effectively remove and/or prevent the return of the aforementioned stubborn shiny film, and wherein said compositions do not have any significant detrimental effect on the floor.

An object of another aspect of the invention is to provide such compositions which can be applied effectively and which are safe for users, especially non-professional handlers, e.g., restaurant workers.

An object of another aspect of the invention is to provide a safe and reliable method for effectively removing slippery-when-wet films from flooring and to return the flooring to its original appearance and high frictional properties.

An object of another aspect is to provide a safe and reliable method for preventing the occurrence of slippery-when-wet films.

An object of another aspect is to provide a safe and reliable method for removing both "polymerized" grease and certain underlying white films from flooring, preferably in a single procedure.

An object of a still further aspect is to provide a test method for determining the desirability of using the below described compositions and methods to remove film from flooring.

Upon further study of the specification and appended claims, further objects and advantages of this invention will become apparent to those skilled in the art.

The terms "flooring" or "floor" in the context of this invention, are meant to include any surface in an environment wherein the slippery-when-wet condition and/or film buildup as above described might occur, such flooring including but not limited to, inorganic materials, e.g., ceramic tile and natural stone, with quarry tile being of particular importance. Also, whereas flooring in restaurants, especially "fast food" restaurants, is of particular pertinence in this invention, other environments include, but are not limited to, food processing and/or preparation establishments, slaughter houses, packing plants, shortening production plants, any and all kitchen areas, etc.

With respect to the term "slippery-when-wet" in the context of this invention, reference is invited to ASTM Standard D-2047, "Static Coefficient of Friction of Polish Coated Floor Surfaces as Measured by the James Machine" and a report by ASTM Committee D-21 which indicated that a floor having a coefficient of static friction of not less than 0.5 as measured by this test is recognized as providing non-hazardous walkway surfaces. This value is qualified in NBS Technical Note 895 "An Overview of Floor Slip-Resistance, With Annotated Bibliography" by Robert J. Brungraber, wherein it is indicated that the value of 0.5 provides a factor of safety and that most people, taking normal strides, would be unlikely to slip on surfaces for which the value is greater than 0.3–0.35. In view of the activity of children and busy personnel in restaurants, a slippery-when-wet floor is characterized conservatively herein, as a wet floor having a coefficient of static friction of less than 0.4. It is also not unusual for the flooring to exhibit values of less than 0.4 in the dry state, depending on the type of conventional cleaning procedures employed.

Thus, another aspect of the present invention is to obtain flooring having correspondingly higher values for the coefficient of static friction in the dry state.

To attain these objects, laboratory and field studies were first undertaken to determine the nature of the stubborn detergent-resistant film. Through special analytical techniques, including the use of X-ray photoelectron spectroscopy, these studies revealed, rather surprisingly, no detectable amount of detergent in the film. Instead, the film is predominantly composed of calcium, magnesium, "polymerized" fats and fatty derivatives. Thus, without being necessarily bound by this explanation of the nature of the film, it appears to be made up of chemically-combined water-hardness minerals and "polymerized" grease (animal and vegetable fats).

In other words, the film is neither soap scum nor detergent scum, nor detergent-removable grease, but rather appears to be an adduct of calcium and/or magnesium ions with fats and/or derivatives thereof. The calcium and magnesium ions, being divalent, can cross link carboxylate groups present in the fatty molecules on the one hand and can also attach the polymerized film to the tile, on the other hand. Crosslinking also occurs via carbon to carbon bonds, and it is likely that the fats are polymerized through cross linking in a manner similar to that of drying oils such as linseed oil as well. Formula 1 illustrates some of the types of bonding which are believed responsible for the cohesive and adhesive properties of the polymerized films.

It was further determined that an observable thickness of shiny detergent-resistant, slippery-when-wet film can reoccur within a relatively short time, e.g., only 2 weeks after the removal of the detergent-resistant film. Consequently, without being necessarily bound by an explanation of this aspect of the invention, a very thin layer of "polymerized" film as set forth in Formula 1 is the causative factor for the wet slipperiness which can occur within about two weeks.

Whereas two week film could be removed with the compositions of this invention, using an ordinary mopping procedure, as a film increases with age, it becomes so polymerized that simple mopping will be ineffective, thereby requiring a much more labor-intensive treatment to remove the difficultly removable film.

In addition, it was determined in at least one test that after the original removal of the detergent-resistant film, the wet slipperiness of the flooring increased from day to day so that after only 8 days, the wet slipperiness of the floor corresponded to a coefficient of static friction of 0.35. This was caused by a buildup allowed to form on the floor as a result of ordinary cleaning procedures used in practice.

FORMULA 1: POLYMERIZED GREASE FILM MOLECULAR MODEL

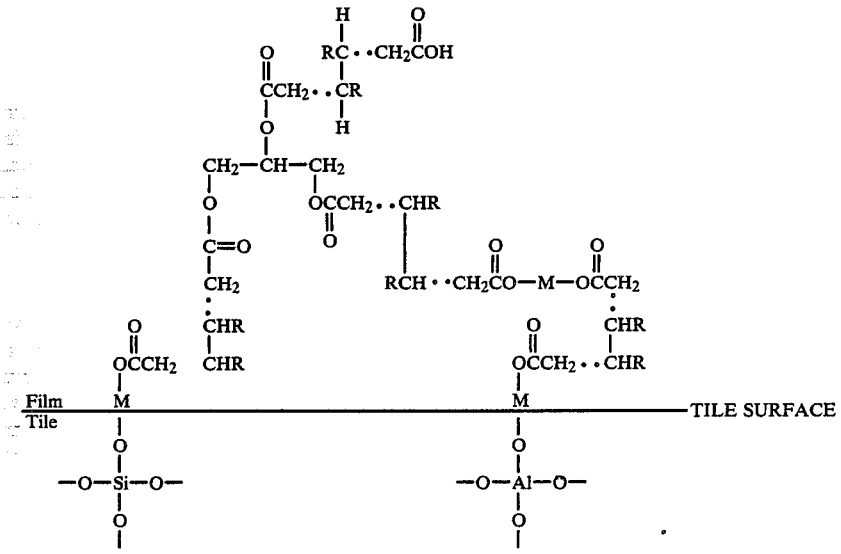

M represents $Ca^{2+}$, $Mg^{2+}$

R represents remainder of fatty molecule or polymeric chain

. . . represents $(CH_2)_x$ wherein x is such that $CH_2$ . . . (CH)R generally represents a chain of about 10–18 carbon atoms A restaurant field study revealed that the longer the film was on the floor, the more difficult it was to remove—which indicates increased cross linking with respect to time. In this study, it was furhter seen that many floors were marred with spots which were determined to be attributable to acidic berverage spill (citrus juice or carbonated beverages). The acidic berverage spills had partially or totally removed the shiny wax-like film to reveal either full, new-appearing tile, or on some occasions, tile covered by a thin white film of a very insoluble and intractable material to be described in greater detail below. On the other hand, not infrequently, the films were so extensively "polymerized" that they were impervious to acidic beverage spills.

Based on these findings, several different compositions and cleaning methods were developed to eliminate wet slipperiness and detergent-resistant films. An associated testing method was also developed to determine the applicability of the present invention to any given floor.

Specific compositions of this invention include: (a) strippers (one step and two step) useful for removing unwanted film from flooring, and (b) maintenance compositions useful for maintaining flooring free from unwanted film. The maintenance compositions include maintenance additive (to be added to conventional detergent solutions) and maintenance/cleaner (single system) products. The compositions may be manufactured and supplied in conventional forms, e.g., in the dry form, or in the form of a paste, or as a concentrated or ready to use aqueous solution. Aqueous solutions of the composition may be applied directly to an entire floor or wherever desired (after being diluted to a working strength if not in a ready to use form).

A method for removing unwanted film from flooring comprises the following steps: (a) applying an acidic floor cleaning composition containing sufficient surfactant to remove surface unpolymerized soil and sufficient acid to remove the detergent resistant film (one step stripper); (b) scrubbing the floor, advantageously manually with a suitable low-density open non-woven abrasive pad or an abrasive brush, or with a floor machine when manageable; (c) optionally scrubbing grout joints with a brush; and (d) removing the stripper solution from the floor.

Instead of using the preferred one step stripper, it is also possible to remove the detergent-removable, non-polymerized soil with a conventional detergent composition and then in a second step, apply an acidic stripper solution which contains an amount of surfactant less than that used in the one step stripper.

Important to this invention is not only the removal of the detergent-resistant, shiny, transparent film, but also the prevention of its occurrence or reoccurrence. Additionally, it is important to prevent the floor from becoming slippery-when-wet irrespective of the nature of film. In this respect, a maintenance solution is applied to the floor, preferably on a regular schedule, so as to prevent development of the slippery-when-wet condition and/or the formation of the detergent-resistant film.

Many compositions of the subject invention comprise the following components (on a parts by weight dry basis):

(a) from 1–60, preferably 5 to 60 of at least one first component, such as, e.g., citric acid, isocitric acid, tartaric acid, malic acid, acetic acid, monohydroxyacetic acid, and gluconic acid, or salts thereof, the first component acid having a pK value of preferably greater than 2.8 at 25° C.;

(b) from 0.1–15, preferably 0.5 to 15 of at least one second component, such as, e.g., sulfamic acid, maleic acid, phosphoric acid, sodium bisulfate, sodium bisulfite, hydrochloric acid, sulfuric acid, nitric acid, and esters (for example, alkyl, e.g., $C_8$–$C_{18}$ esters of sulfuric or phosphoric acid) or salts thereof, the second component acid having a pK value at 25° C. of preferably less than 2.5, with the provision that at least one of (a) and (b) provides free acid.

With respect to the above acidic components, it is contemplated that the composition will be essentially, if not completely free of hydrofluoric acid, or an equivalent fluoride thereof, e.g., $NH_2SiF_6$, $NH_4F$, $NH_4HF_2$, and $(NH_4)_2SiF_6$, i.e., the composition will not contain hydrofluoric acid or an equivalent thereof as an essential component. In addition, it is contemplated that the formulation will be essentially if not completely free of other hazardous and toxic substances such as for example, oxalic acid, cresylic acid, formic acid, chromic acid, etc. Consequently, the products of this invention are designed to be safe with respect to the floor, to the equipment on the floor, and most importantly, to food-service personnel who will be able to handle the formulations competently. It is further noted that the composition does not require unusual acids such as glutaric acid; consequently, in a composition aspect of the invention, the composition will be essentially, if not completely, free of glutaric acid;

(c) a sufficient amount, but preferably not more than 80 parts of a buffering salt (such as, e.g., sodium acid pyrophosphate, monosodium phosphate, sodium acetate, sodium citrate) for maintaining an aqueous solution of said composition at a pH in a range of from about 1 to about 6, preferably 1–6, more preferably about 1–5, said salt optionally being the identical entity as a salt selected from group (a) or (b);

(d) 0 to 10 of hydrotrope, such as, e.g., sodium alkylnaphthalene sulfonate and sodium xylene sulfonate the function of the hydrotrope being to provide a clearer and more stable system in liquid formulations and to help protect the product from moisture in powder formulations;

(e) 0 to 40 of surfactant to decrease surface tension and to aid film removal by acids;

(f) 0 to 10 of fumed silica and/or other equivalent processing aid for providing free-flow characteristics to powdered material and to retard moisture absorption;

(g) 0 to 15 of sodium tripolyphosphate for removing water hardness deposits and rust stains;

(h) 0 to 50 of filler, such as, e.g., sodium chloride, sodium sulfate, potassium chloride, and potassium sulfate; and depending on the particular composition type, e.g., dry or liquid, concentrate or ready-to use, as much water as required will be added.

It is also contemplated that the composition may comprise other ingredients, for example, components added for aesthetic purposes, e.g., perfumes and dyes as well as neutralizing agents and foam stabilizing agents.

It is further preferred for the buffered acid compositions described above to exhibit a relatively high total acid to free acid ratio, e.g., at least over 2.5., especially over 3, and advantageously over 4. (The free acid is measured with a pH meter by titrating with an 0.5 normal solution of sodium hydroxide to a pH of 4.1 (simulating a methyl orange endpoint) and the total acid is measured by titrating with the same solution to a pH of 8.5 (simulating a phenolphthalein endpoint).

Accordingly, the preferred buffered compositions of the invention can be described, while implicitly incorporating the above caveats, simply as comprising:

a first component being at least one acid or salt thereof, wherein said acid has a pK value at 25° C. of greater than 2.8, a second component being at least one acid or salt thereof wherein said acid has a pK value at 25° C. of less than 2.5, with the provision that at least one of the first or second components provides free acid and at least one buffering salt of a weak acid, said buffering salt being the same as or different from said first or second component;

and wherein the ratio of the total acid to the free acid in said composition is at least 2.5, especially at least 3 and advantageously at least 4, depending on the particular composition as described below and wherein an aqueous solution of said composition preferably has a pH of 1 to 4.1.

In the context of this invention, a weak acid is any acid which is not a strong acid, i.e., an acid which is not fully dissociated. Salts of weak acids comprise, for example, a source of a completely or partially neutralized salt of a polybasic acid, e.g., $Na_2HPO_4$, or a salt of a monobasic acid such as, for example, a source of the sodium salt of monohydroxyacetic acid.

It is to be understood that whereas a combination of (a) and (b) acids is preferred, this invention also contemplates the use of solutions having a single acid group.

For example, an acid from the first component weaker acid group will remove the difficultly removable film and will also be sufficient to prevent the formation of slippery-when-wet condition; however the film removal will be relatively slow. Conversely, an acid from the second group will also work by itself, but at some sacrifice to the safety of personnel and with an associated risk of undesired attack on equipment, grout, etc. Nevertheless, it is to be understood that a broad aspect of this invention is the discovery that the hard, shiny transparent, detergent-resistant difficultly removable film of polymerized grease can be removed with acidic solutions essentially free of hydrofluoric acid. A further broad aspect is the discovery that flooring can be prevented from developing a slippery-when-wet condition by applying such an acidic solution on a periodic basis. In both cases, it is highly preferred to incorporate a surfactant in the acidic solution.

Likewise, whereas the presence of at least some buffer in all compositions is preferred, compositions without buffer are also useful, it being possible to achieve a degree of pH control by mixing acids of groups (a) and (b) at appropriate ratios.

It is to be further understood that the pH of the solutions that are applied to the floor is very important. The solution must on the one hand be sufficiently strongly acidic to be effective to help remove the film, and on the other hand sufficiently weakly acidic to be safely handled by restaurant personnel as well as being essentially non-deleterious to grout. (Grout generally employed is either a conventional mixture of sand, Portland cement and latex or a conventional epoxy composition.) In general, the pH range of such solutions in ready-to-use form is 1 to about 6, particularly 1–6, especially 1–5, preferably 1–4.1, more preferably 1.8–4.05 and particularly preferred 2.3–3.2. The most preferred pH range for the one step stripper solution is about 2.2–2.8, especially about 2.4–2.8, the two step stripper about 1.9–2.8, especially about 2.2–2.6, and the maintenance cleaner solution about 2.3–4.1, especially about 2.8–3.5, all of these solutions being described in greater detail below.

A maintenance cleaner powder on the other hand, can be used in concentrated aqueous form, e.g., 60% w/w % which could be used as a stripper, such a material having a pH of about 1.1–1.2. Conversely when the maintenance cleaner powder is employed in aqueous solution for maintenance purposes, e.g., 0.075–7.5, especially about 0.75 w/w %, the pH of such a solution is generally about 2.4–4, and especially about 3, respectively.

As for the liquid concentrates to be used to make up such solutions, the pH of such concentrates have a lower limit of preferably 1.7 so as to be safely handleable by restaurant personnel, with the preferred upper limit being below the lower preferred limit of the corresponding ready-to-use solution.

Several compositions for performing various desired functions (including stripping built-up film from flooring, maintaining flooring free from undesired film, and for the optional testing of flooring to determine the desirability of employing the instantly-described compositions and methods) are contemplated and will be described in detail. Methods for performing each of these functions will be described as well.

I. Strippers (Removers of Polymerized Grease Film)

Stripper compositions are especially useful for removing the above described film layer containing polymerized grease frequently found on ceramic tile flooring in foodservice establishments.

Preferred stripper compositions are characterized by the previously-noted preferred general formulation and are further preferably limited to: citric acid, as the weaker acid, phosphoric acid, as the stronger acid, and monosodium phosphate and/or sodium acid pyrophosphate, as the buffer. For example, a useful stripper composition can comprise:

(a) 4 to 60 parts of citric acid;
(b) 0.1 to 15 parts of sulfamic acid and/or phosphoric acid;
(c) 0.1 to 40 parts of monosodium phosphate and/or sodium acid pyrophosphate;
(d) 0 to 10 parts of hydrotrope;
(e) 0 to 30 parts of nonionic and/or anionic surfactant;
(f) 0 to 10 parts of fumed silica;
(g) 0 to 15 parts of sodium tripolyphosphate;
(h) 0 to 50 parts of filler;
(i) 0 to 5 parts of neutralizer; and
(j) 0 to 10 parts of foam stabilizer.

The efficaciousness of citric acid is believed due not only to the acidity thereof but also to its sequestering activity, i.e., its ability to sequester water hardness components such as calcium and magnesium ions, thereby breaking bonds between such ions and the ceramic tile and/or removing a cross linking bridge between chains of fatty molecules.

A particularly preferred formulation of the stripper contains sufficient detergent to function not only as an aid for the removal of polymerized grease but also to remove superficial non-polymerized soil as well. This formulation, which permits the elimination of a prewashing step, contains additional surfactant and hydrotrope and may also contain other conventional adjuvants such as solvent, foam stabilizers, etc.

The pH of aqueous solutions of stripper compositions in ready-to-use form is subject to the above recited pH ranges. Stripper compositions are made by mixing ingredients in any order and are supplied either dry or, preferably, in a concentrated aqueous solution.

Dry stripper compositions should be placed into solution before being applied to flooring, and liquid concentrated stripper should be diluted to a working strength. An aqueous stripper solution of from about 3 percent to about the full strength of the concentration, preferably not more than 60 percent of the stripper concentrate by weight is useful for removing the hard, shiny, transparent, polymerized-grease-containing, detergentresistant, slippery-when-wet film from flooring. In a typical mop bucket, stripper composition is added to water, preferably hot water, to produce a stripper solution for use in conjunction with a stripper method.

Preferred and particularly preferred two step liquid (including paste) and powder concentrates comprise the following components tabulated below:

TWO STEP
LIQUID STRIPPER CONCENTRATE
W/W %

| Component | Preferred | Particularly Preferred |
|---|---|---|
| Citric or other acid of weaker group | 6–24 | 10–15 |
| Phosphoric or other acid of stronger group | 0.5–4 | 1–2.5 |
| Buffer | 0.1–40 | *10–25 |
| Hydrotrope | 0.4–2.4 | **1.4–2.4 |

-continued

| TWO STEP LIQUID STRIPPER CONCENTRATE W/W % | | |
|---|---|---|
| Component | Preferred | Particularly Preferred |
| Surfactant | 0.25–4 | 0.5–2 |
| Filler | 1–8 | 2–6 |
| Sodium Tripolyphosphate | 0.05–8 | 0.1–1 |
| Water | balance | balance |

Particularly preferred components
*Monosodium phosphate: 20.0 parts by weight and sodium acid pyrophosphate: 0.5 parts by weight
**Source of sodium xylene sulfonate, 40% by weight.

To make the ready-to-use solution, such concentrates are diluted with water up to preferably not more than 32:1 by weight, and preferably using about a 3:1 dilution.

| STRIPPER POWDER CONCENTRATE Weight % (Dry Basis) | | |
|---|---|---|
| Component | Preferred | Particularly Preferred |
| Citric or other acid of weaker group | 15–45 | 25–35 |
| Phosphoric or other acid of stronger group | 1–8 | 3–5 |
| Buffer | 0.1–60 | *20–55 |
| Hydrotrope | 0.2–2 | **0.2–1 |
| Fumed silica | 0.1–2 | 0.3–1.0 |
| Surfactant | 1–5 | ***1.5–3 |
| Filler | 4–18 | ****5–15 |
| Sodium Tripolyphosphate | 0.1–3.0 | 0.5–2 |

Particularly preferred components
*Monosodium phosphate: 50.5 parts and sodium acid pyrophosphate: 1.5 parts
**Sodium alkylnaphthalene sulfonate
***Ethoxylated (9–10 mole) nonylphenol
****Sodium chloride Powders generally have less than 3% by weight of $H_2O$, depending on the manufacturing procedure, the nature of starting material and the relative humidity.

Preferred and particularly preferred one-step strippers are preferably liquid concentrates which comprise the following components:

| ONE-STEP LIQUID STRIPPER CONCENTRATE W/W % | | |
|---|---|---|
| Component | Preferred | Particularly Preferred |
| Citric or other acid of weaker group | 4–20 | 7–12 |
| Phosphoric or other acid of stronger group | 0.7–3 | 1–2 |
| Buffer | 8–32 | 12–18 |
| Hydrotrope | 2–9 | 3.4–6.5 |
| Surfactant | 1–15 | 5–8 |
| Filler | 1–8 | 2–5 |
| Neutralizer | 0.6–3 | 1–2 |
| Foam Stabilizer | 0.8–3.5 | 1.3–2 |
| Water | balance | balance |

II. Manintenance Additive Compositions

Mantinance compositions according to the general formulation are usefull for maintaining restaurant flooring free of unwanted polymerized film and in any case prevent the return of a slippery-when-wet condition to the floor when used at appropriate intervals.

Maintenance additive compositions can be either liquid or powder. When liquid, the maintenance additive is preferaby of the same formula as the two step stripper liquid concentrate. When powder, the maintenance compositions preferably comprise the following components:

(A) 15 to 45% especially 25–35% of the weaker acid group, especially citric acid;
(b) 2 to 8% especially 3–5% of the stronger acid group, especially sulfamic and/or phosphoric acid;
(c) 40 to 70% especially 50–60% of buffer, preferably monosodium phosphate and/or sodium acid pyrophosphate;
(d) 0.1 to 2% especially 0.2–1.0% of hydrotrope;
(e) 0.1 to 2% especially 0.3–1.0% of fumed silica or equivalent thereof;
(f) 0.5 to 3% especially 1.0–2.0% of sodium tripolyphosphate; and
(g) 5 to 20% especially 5–15% of filler.

All percentages are based on the total weight of all components.

Good results are obtained by combining maintenance additive with detergent of the following formulation:

(a) 1 to 50% of an anionic surfactant, such as, e.g., linear alkylbenzene sulfonate, sodium laurylether sulfate, sodium alpha olefin sulfonate, sodium lauryl sulfate, or other anionic surfactant;
(b) 1 to 25% of a detergent adjuvant, such as a coconut fatty acid alkanolamide or other fatty acid amide, or lauryl dimethylamineoxide;
(c) 2 to 50% of nonionic surfactant, such as, e.g., ethoxylated alkylphenol, modified ethoxylated and/or propoxylated straight-chain alcohol, or other nonionic surfactant; and
(d) 0 to 10% of a sequestering agent, such as, e.g., sodium EDTA, sodium gluconate, sodium glucoheptonate, sodium citrate, trisodium N-hydroxyethylene diamine triacetate or other sequestering agent;

all percentages being by weight and based on the total weight of all components of the detergent.

The maintenance additive is advantageously added to an aqueous detergent solution to produce a maintenance solution which, when applied periodically, preferably daily, to ceramic tile flooring (in the same manner as conventional floor cleaning products, e.g., by vigorous mopping or brushing), keeps flooring substantially free of unwanted film. The maintenance solution contains, e.g., from 0.0375 to 4.0 weight percent of maintenance additive.

To ensure proper mixing by restaurant personnel, the maintenance additive is preferably packaged in a premeasured packet with instructions to add the packet contents [2 ounces (57 grams) maintenance composition] to each mop bucket [about 4 gallons (15.2 liters)] of preferably hot detergent solution [0.1 to 10 ounces weight per gallon (about 0.75 to 75 grams per liter)].

In any case, when the maintenance additive is added to the mop bucket, the resultant solution will have a pH within the above recited ranges, with a pH of about 3.1 being the most advantageous. The preferred proportion of maintenance additive to water is about 0.5 ounces by weight to 1 gallon of water.

III. Maintenance/Cleaner Compositions

Maintenance/Cleaner compositions according to the general formulation are outstandingly useful as a single system floor cleaning and film-preventing product. Maintenance/cleaner on the one hand does not need to be added to detergent solution and on the other hand is far less dependent on the degree of care used in the cleaning procedure than are conventional detergents. In other words, using the same procedure, the maintenance cleaner of this invention will yield better cleaning results than many, if not all, conventional detergents.

Maintenance/cleaner powder and liquid compositions advantageously comprise the following components:

| MAINTENANCE CLEANER/POWDER) Weight % (Dry Basis) | | | |
|---|---|---|---|
| Component | Most Preferred | Preferred | General |
| Citric or other weaker acid | 10–20 | 7–30 | 5–60 |
| Sulfamic or other stronger acid | 0.5–1.5 | 0.1–6 | 0.1–15 |
| Buffer | 20–45* | 15–50 | 0.1–80 |
| Hydrotrope | 0.3–1.0** | 0.1–2.0 | 0–10 |
| Fumed silica | 0.3–1.0 | 0.1–2.0 | 0–10 |
| Surfactant | 30–40*** | 15–40 | 5–40 |
| Filler | 10–20 | 5–30 | 0–50 |
| Water | up to 3 | up to 3 | up to 3 |

Preferred Components
*Sodium acid pyrophosphate
**Sodium alkylnaphthalene sulfonate
***Mixture of Sodium dodecylbenzene sulfonate: 20.0%, Coconut fatty acid monoethanolamide: 12.0, and Ethoxylated (9.5 mole) nonylphenol: 3.0

| MAINTENANCE CLEANER/LIQUID) (W/W %) | | | |
|---|---|---|---|
| Component | Most Preferred | Preferred | General |
| Citric or other weaker acid | 6–10 | 6–16 | 1–60 |
| Phosphoric and/or other stronger acid | 1.5–2.5 | 1–5 | 0.5–15 |
| Buffer | 8–18 | 2–20 | 0.1–80 |
| Hydrotrope | 6–13 | 4–16 | 0–20 |
| Surfactant | 16–26 | 10–35 | 5–40 |
| Filler | 0.6–1.1 | 0.4–1.3 | 0–50 |
| Neutralizer | 6–11 | 4–20 | 0–60 |
| Foam Stabilizer | 1.3–2.2 | 0.6–20 | 0–25 |
| Solvent (Thinner) | 1.5–2.5 | 1–3 | 0–5 |
| Water | 25–35 | 10–45 | 10–89 |

Instead of powders or liquids, pastes or slurries can be used. For example, by incorporating about 3–10% by weight of water in the powder compositions, such alternative paste-like forms can be produced.

These compositions are easily made by mixing components in any order. When applied to flooring on a daily basis using proper procedures (e.g., sufficient solution on mop to make floor substantially wet), aqueous (0.075–7.5, preferably 0.5–1.0 weight percent), solutions of these compositions maintain a polymerized-film-free ceramic tile floor.

It is also a preferred embodiment of this invention to package the maintenance cleaner in a premeasured portion packed sealed package. For example, easily openable packets containing about 2–4 weight ounces are suitable for adding to a conventional mop bucket. One reason why the maintenance cleaner provides superior cleaning of the floor, without being bound by the explanation, is that acidity of the cleaner apparently leads to the protonation of carbonyl oxygens and resultant solubilization of the fatty materials.

The maintenance cleaner composition will yield substantially the same pH values in diluted form as the maintenance additive composition.

IV. Stripper Method

Merely mopping a film-covered floor with stripper solution will neither effectively remove all of the grease film nor remove any significant amount of the underlying white film. A unique combination of factors (including the film's stubborness, safety to cleaning personnel, and the susceptibility of the tile flooring to scratching) requires a stripper method and compatible compositions for removing film without permanently marring flooring and without danger to personnel. One method comprises initially sweeping the floor (to remove any dust, dirt, etc., which may be present), cleaning the floor, i.e., scrubbing the floor with detergent solution and removing spent detergent solution and soil from the floor, applying stripper solution (e.g., by pouring buckets of solution onto the floor or by wet-mopping with generous amounts), scrubbing the floor with special abrasive pads, scrubbing grout joints and then removing the solution from the floor. A particularly advantageous method comprises combining cleaning and stripping in one step wherein the stripper solution is combined with said detergent in sufficient quantity, either in a single solution or as separate additives to the cleaning bucket. Scrubbing grout joints can be effected, e.g., with a deck brush unless some other means is indicated, for example, floor scrubbing machines.

A rigorous experimentation program was conducted using the above-described stripper compositions and a large number of different abrasive means, mostly in the form of abrasive pads which are used manually. Unexpectedly, only a very few of these abrasive pads worked satisfactorily for removing certain underlying white films without being so abrasive as to mar the ceramic tile permanently. Useful pads are based on fine particles of silicon carbide or aluminum oxide, it being important that the particles present a sufficient degree of non resincoated outer surface so as to provide sufficient abrasive action to remove the undesired removable white film. It has been found that pads predominating in resin-coated silicon carbide particles on the outer surface thereof will not work satisfactorily inasmuch as such pads are insufficiently abrasive to remove the fatty film and any underlying white film, the latter being more of a mineral origin. (The white film, generally of siliceous origin has been analyzed at certain sites and is believed to comprise magnesium silicate; however, other compositions may be possible.) It was discovered, moreover, that abrasive pads particularly well-suited for stripping are comprised of a lofty three-dimensional web of organic resinous fibers which are coated with silicon carbide or aluminum oxide abrasive particles. Preferred pads are commercially available from the American Manufacturing Co. of Acworth, Ga., item HP-500 in particular; these pads were originally believed to be based on silicon carbide but upon analysis by the present inventors, were found to be based on aluminum oxide. Preferred silicon carbide pads, on the other hand, are commercially available from the 3M Company of St. Paul, Minn., item #7446 in particular, described as a nonwoven, open textured synthetic fibrous web having abrasive particles dispersed throughout, bonded with a durable, filled, heat resistant binder and having an average thickness of 0.55 inches, the fibers being crimped, heat set dark gray nylon fiber having a maximum filament diameter of 90 denier, and the abrasive being silicon carbide having a Mohr Hardness of 9 and a mineral weight of 14 grams per 24 square inches.

Other abrasive means are also contemplated, e.g., floor scrubbing machines having abrasive brushes or pads, e.g., a nylon brush having embedded silicon carbide or aluminum oxide. Such brushes can also be used manually.

The aforementioned abrasive means assist in the removal of the hardened grease film and are abrasive enough to remove certain underlying white film; they are also gentle enough not to mar ceramic tile permanently. The abrasive pads are preferably used manually.

Field studies have revealed that even severe floor film coatings are effectively removed by the stripper compositions when applied according to this method. Once the floor has been stripped, maintenance mopping with maintenance solution and proper mopping procedures at periodic intervals will prevent the return of the unsightly and dangerously slippery floor film.

V. Maintenance Method

Research has shown that floors in food service environments are constantly susceptible to polymerized grease film build-up. In the case of a new floor, or once the polymerized grease film has been stripped from a used floor by any means, it is cost and labor effective for the maintenance treatment to be conducted periodically, at least on a weekly basis, preferably twice a week, better yet on alternate days, and especially on a daily or even on a more frequent basis which in turn will yield the most insurance against the occurrence or reoccurrence of both the hazardous slippery-when-wet condition of the flooring and the detergent-resistant film. In this connection, it will be possible for a manager to determine the most acceptable schedule at a particular site since the rate of buildup is a function of several local variables, e.g., extent of grease and food spillage, hardness of water, etc. In general, it will be beneficial to use a maintenance solution at the time when the floor is thoroughly cleaned, usually after closing.

The floor maintenance treatment comprises sweeping the floor and then properly mopping and/or scrubbing with a maintenance solution. The maintenance cleaner composition and the product formed by mixing maintenance additive with a detergent solution are equally effective at preventing the return of film-build-up and the need for stripping. In this way both the dry and wet coefficient of static friction can be maintained generally above 0.4 if not above 0.5 on a substantially continuous basis.

Although the presently-described compositions and methods are very effective against films containing polymerized grease and certain underlying white floor films, not all films present on restaurant flooring are of this nature. The inventors have encountered white films which were not effectively removed according to the present invention; these films are thought to result from improper installation of the grout frequently used for restaurant tile floors and from the use of some detergents containing siliceous ingredients. Likewise, the inventors have encountered films having substantially the same appearance as the polymerized grease films, and which are not removable by the present invention. These similarly appearing films are believed to be varnish coats, e.g., polyurethane or sealing coats, and the present invention neither provides for the removal of such films nor deals with the unattractive appearance of the floor when such films start to decompose. Thus, it is optional to test a small area of flooring before utilizing the stripping procedure of the present invention. For this purpose is required a quantity of one step stripper composition diluted to a useful strength, a suitable abrasive pad, and instructions for performing a test on a small area of flooring.

VI. Test Method

The test method preferably comprises: first sweeping a small area of flooring, applying the one step stripper to the small area, scrubbing the area with the abrasive pad, removing the stripper from the test area and evaluating the appearance of the treated area to determine whether the procedure effectively removed the "polymerized" grease film and any underlying white film and restored the original appearance of the ceramic tile. It is recommended that the test, if used in restaurants, be conducted to several areas: an area in the dining room 1 foot wide and 2 feet long next to a baseboard, an area 1 foot×2 feet in the dining room under a table or seat, an approximately 1×2 foot area in the kitchen next to a baseboard, and any portions of the floor which have been replaced or added since the original floor was laid. Without further elaboration, it is believed that one skilled in the art can, using the preceding description, utilize the present invention to its fullest extent. The following examples are, therefore, to be construed as merely illustrative, and not limitative of the remainder of the disclosure in any way whatsoever.

EXAMPLES

I. Stripper

A. Liquid 12 weight percent of citric acid, 2 weight percent as an 85% by weight phosphoric acid, 20 weight percent of monosodium phosphate, 0.5 weight percent of sodium acid pyrophosphate, 4.8 weight percent of 40% by weight sodium xylene sulfonate, 1.0 weight percent ethoxylated (9.5 mole) nonylphenol, 0.5 weight percent of sodium tripolyphosphate, and 4.0 weight percent of sodium chloride (filler) are mixed in any order with 55.2 weight percent (balance) water to produce a concentrated aqueous stripper solution. This solution is useful for removing stubborn "polymerized" grease film from restaurant flooring when diluted to a 12 percent by weight solids working strength solution (with hot water) and applied according to the stripper method.

B. Powder

A stripper powder concentrate found to be especially effective contains on a percent by weight basis 29.7 citric acid, 4.2 of 85% by weight phosphoric acid, 50.5 monosodium phosphate, 1.5 sodium acid pyrophosphate, 0.5 sodium alkylnaphthalene sulfonate, 0.6 fumed silica, 2.0 ethoxylated (9.5 mole) nonylphenol, 8.8 sodium chloride, 1.5 sodium tripolyphosphate and 0.7 water. This powder is then mixed with water to form a stripping solution.

II. Maintenance Additive 29.6 weight percent of citric acid, 4.3 weight percent sulfamic acid, 44.5 weight percent of monosodium phosphate, 8.9 weight percent of sodium acid pyrophosphate, 0.7 weight percent of sodium alkylnaphthalene sulfonate, 0.6 weight percent of fumed silica, 1.5 weight percent of sodium tripolyphosphate, and 9.9 weight percent of sodium chloride are mixed in any order to produce a granular mixture. A quantity of maintenance additive is added to a sufficient quantity of hot detergent solution to produce an aqueous 0.38 percent by weight maintenance additive solution and an 0.75% by weight detergent solution. This solution is wet-mopped onto restaurant tile flooring, which is deck-brushed and then rinsed, to keep such flooring free of unwanted film.

III. Maintenance Cleaner 15 weight percent of citric acid, 3 weight percent of sulfamic acid, 33 weight percent of sodium acid pyrophosphate, 12 weight percent of linear alkylbenzene sulfonate, 3 weight percent of ethoxylated (9 moles) nonylphenol, 12 weight percent of coconut fatty acid monoethanol amide, 0.5 weight percent of sodium alkylnaphthalene sulfonate, 0.5 weight percent of fumed silica and 21 weight percent of sodium chloride are mixed in any order. The resulting composition is added, in sufficient quantity to an appropriate volume of hot water, to produce a 0.75 percent (by weight) solution of maintenance cleaner. This solution is wet-mopped onto restaurant tile flooring, which is deck-brushed and then rinsed, to keep such flooring free of unwanted film.

The following exemplified dilutions and associated pH values are generally attainable:

| | | |
|---|---|---|
| 1. Stripper liquid and maintenance additive liquid: | | |
| Concentration | pH | |
| Concentrate: | 1.95 | |
| 25% (v/v): | 2.52 - | approximate use level for stripper |
| 1.0 oz/gallon in 1.0 oz/gallon detergent: | 3.3 - | approximate use level for maintenance additive |
| 0.5 oz/gallon in 1.0 oz/gallon detergent: | 3.9 | |
| 2. Stripper powder and maintenance additive powder | | |
| 60% solution (w/w): | 1.88 | |
| 12% solution (w/w): | 2.39 - | approximate use level for stripper |
| 1% solution (w/w): | 2.77 | |
| 0.5 oz/gallon in 1.0 oz/gallon detergent | 3.10 - | approximate use level for additive |
| 3. Maintenance cleaner liquid: | 1.79 | |
| 10% (v/v): | 2.30 | |
| 1.0 oz/gallon: | 2.90 - | approximate use level |
| 0.1 oz/gallon: | 4.12 | |
| 4. Maintenance cleaner powder | | |
| 10% solution (w/w): | 2.46 | |
| 1.0 oz/gallon: | 3.04 - | approximate use level |
| 0.5 oz/gallon: | 3.29 | |

w = weight
v = volume
oz = ounce (weight)

IV. Compositions Without Buffer

As previously noted, useful compositions which do not include buffer are optionally prepared. The particular acidic components and amounts thereof must be carefully chosen so that the resulting composition is safe for users, for example, non-professional handlers (i.e., restaurant employees) and for materials and components which are part of and/or adjacent to flooring in a restaurant environment, e.g., grout, aluminum trim around doors and windows, posts, woodwork, painted surfaces, plastics, etc. For example, 12.0 weight percent citric acid, 2.0 weight percent phosphoric acid as of 85% by weight phosphoric acid, 4.8 weight percent of 40% by weight sodium xylene sulfonate, 1.0 weight percent ethoxylated (9–10 moles) nonylphenol, 24.5 weight percent sodium chloride, 0.5 weight percent sodium tripolyphosphate, and 55.2 weight percent water are mixed in any order to produce a concentrated aqueous stripper solution. This solution is useful for removing stubborn "polymerized" grease film from flooring and is diluted to a 12 weight percent by solids working strength solution.

Maintenance additive and maintenance cleaner compositions which do not include buffer are similarly prepared. For example, useful embodiments of each are prepared by substituting filler for buffer and reducing the proportion of the stronger acid in each of representative examples II and III. Specifically, an example of liquid stripper or liquid maintenance additive having no buffer contains, on a weight percent basis, 20% citric acid, 0.9% sulfamic acid and 79.1% water. The pH of this solution is 1.0, but when diluted 50%, the pH is 1.34, diluted to 1%, the pH is 2.68 and diluted to 0.1% the pH is 3.55.

An example of a buffer-free powdered stripper or maintenance additive is a composition of, in percent by weight 95.7% citric acid and 4.3% sulfamic acid which at a concentration in water of 20.9% has a pH of 1.0; at 10.5%, a pH of 1.34; at 0.21%, a pH of 2.68; and at 0.021%, a pH of 3.55.

Finally, in a similar manner, single acid compositions are also useful so long as the proper pH is maintained.

TEST METHOD

Permit the one step stripper solution to remain on the small testing area about 15 minutes and then scrub hard with enclosed pad for about 5–10 strokes; mop up test area with a clean mop, rinse with hot water, mop, and then dry. If test areas exhibit a dull rather than shiny appearance, and there is no refractory white film, flooring can be greatly benefitted by the present invention.

As contrasted with the test method, the other methods disclosed herein relate to the cleaning of a large area of the floor, i.e., substantially, if not completely, the entire floor of any given room, for example, a unitary area of at least 25 square feet, especially at least 50 square feet, and preferably at least 100 square feet.

It is further to be understood that when a maintenance solution is employed, the floor is to be essentially devoid of a difficultly removable detergent-resistant shiny transparent film of "polymerized grease". By "essentially devoid" is meant not so much of a buildup as to result in a slippery-when-wet condition.

PREFERRED EMBODIMENTS

The following self-explanatory tables set forth the preferred embodiments of the invention:

A—One Step Stripper Liquid
B—Two step Stripper Liquid
C—Maintenance Cleaner Powder
D—Maintenance Cleaner Liquid The preceding examples and preferred embodiments can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions. For example, whereas the compositions of this invention have particular application for the cleaning of flooring, especially in those environments discussed above conducive to the buildup of "polymerized grease", the compositions can also be used in other more general cleaning applications where an acidic detergent composition is useful. Also, the physical forms of the compositions can vary. For example, the concentrates can be used in the form of a tablet aside from liquid, powder, paste and slurry forms.

With respect to the following claims, it is to be understood that the named components can be either used as such or can be formed in situ. Thus, for each component named, the claims are to be interpreted as a "source" for each component, e.g., "0.1 to 80% of buffer" means a "source of 0.1 to 80% buffer". Also, to the extent that any of the claimed compositions or claimed methods do not find identical antecedent basis in this specification, such originally claimed compositions and originally claimed methods are hereby incorporated into the specification.

(A)
ONE STEP STRIPPER LIQUID

| INGREDIENTS | GROUP | W/W % CONC. | USE CONCENTRATIONS - W/W % Normal - 25% | Low Limit - 3% | High Limit - 100% |
|---|---|---|---|---|---|
| Water | | 55.485 | 88.873 | 98.663 | 55.485 |
| Citric Acid | Weaker Acid | 9.155 | 2.289 | 0.275 | 9.155 |
| Phosphoric Acid | Stronger Acid | 1.530 | 0.383 | $4.59 \times 10^{-2}$ | 1.530 |
| Monosodium Phosphate | Buffer | 15.258 | 3.814 | 0.458 | 15.258 |
| Sodium Acid Pyrophosphate | Buffer | 0.381 | $9.525 \times 10^{-2}$ | $1.14 \times 10^{-2}$ | 0.381 |
| Sodium Xylene Sulfonate | Hydrotrope | 5.220 | 1.305 | 0.157 | 5.220 |
| Ethoxylated Nonylphenol (9.5 mole EO) | Surfactant | 3.524 | 0.881 | 0.106 | 3.524 |
| Sodium Chloride | Filler | 3.052 | 0.763 | $9.16 \times 10^{-2}$ | 3.052 |
| Isopropyl Alcohol | Solvent | 0.460 | 0.115 | $1.38 \times 10^{-2}$ | 0.460 |
| Dodecylbenzene Sulfonic Acid | Surfactant | 2.854 | 0.713 | $8.56 \times 10^{-2}$ | 2.854 |
| Triethanolamine | Neutralizer | 1.418 | 0.354 | $4.25 \times 10^{-2}$ | 1.418 |
| Coconut Fatty Acid Alkanolamide | Foam Stabilizer | 1.658 | 0.414 | $4.97 \times 10^{-2}$ | 1.658 |
| Herbal Fragrance | Perfume | 0.005 | $1.25 \times 10^{-3}$ | $1.50 \times 10^{-4}$ | 0.005 |
| TOTAL SOLIDS | | 44.515 | 11.127 | 1.337 | 44.515 |
| pH | | 2.27 | 2.60 | 2.74 | 2.27 |

(B)
TWO-STEP STRIPPER LIQUID

| INGREDIENTS | GROUP | W/W % CONC. | USE CONCENTRATIONS - W/W % NORMAL 25% | LOW LIMIT 3% | HIGH LIMIT 100% |
|---|---|---|---|---|---|
| Citric Acid | Weaker Acid | 12.000 | 3.000 | 0.3600 | 12.000 |
| Phosphoric Acid | Stronger Acid | 2.000 | 0.500 | 0.0600 | 2.000 |
| Monosodium Phosphate | Buffer | 20.000 | 5.000 | 0.6000 | 20.000 |
| Sodium Acid Pyrophosphate | Buffer | 0.500 | 0.125 | 0.0150 | 0.500 |
| Sodium Xylene Sulfonate | Hydrotrope | 1.920 | 0.480 | 0.0576 | 1.920 |
| Ethoxylated Nonylphenol (9.5 mole EO) | Surfactant | 1.000 | 0.250 | 0.0300 | 1.000 |
| Sodium Chloride | Filler | 4.000 | 1.000 | 0.1200 | 4.000 |
| Sodium Tripoly Phosphate | | 0.500 | 0.125 | 0.0150 | 0.500 |
| Herbal Fragrance | Perfume | $5.00 \times 10^{-3}$ | $1.25 \times 10^{-3}$ | $1.50 \times 10^{-4}$ | $5.00 \times 10^{-3}$ |
| Phthalocyanine-Anthraquinone | Dye | 0.100 | 0.025 | 0.0030 | 0.100 |
| Water | | 57.975 | 89.494 | 98.7392 | 57.975 |
| Total Solids | | 42.025 | 10.506 | 1.2608 | 42.025 |
| pH | | 1.95 | 2.41 | 2.72 | 1.95 |

(C)
MAINTENANCE CLEANER POWDER

| INGREDIENTS | GROUP | W/W % Conc. | Use Concentrations - W/W % Normal 0.75% | Low Limit 0.075% | High Limit Maintenance 7.5% | High Limit Stripping 60% |
|---|---|---|---|---|---|---|
| Citric Acid | Weaker Acid | 15.000 | 0.112 | 0.0112 | 1.125 | 9.000 |
| Sulfamic Acid | Stronger Acid | 0.700 | $5.25 \times 10^{-3}$ | $5.25 \times 10^{-4}$ | 0.0525 | 0.420 |
| Sodium Acid Pyrophosphate | Buffer | 33.000 | 0.248 | 0.0248 | 2.475 | 19.800 |
| Sodium Alkyl Naphthalene | Hydrotrope | 0.500 | $3.75 \times 10^{-3}$ | $3.75 \times 10^{-4}$ | 0.0375 | 0.300 |

-continued (C)
MAINTENANCE CLEANER POWDER

| INGREDIENTS | GROUP | W/W % Conc. | Use Concentrations - W/W % Normal 0.75% | Low Limit 0.075% | High Limit Maintenance 7.5% | High Limit Stripping 60% |
|---|---|---|---|---|---|---|
| Sulfonate | | | | | | |
| Cab-O-Sil | Drying/Free Flow Agent | 0.500 | $3.75 \times 10^{-3}$ | $3.75 \times 10^{-4}$ | 0.0375 | 0.300 |
| (a) | Surfactant | 35.000 | 0.262 | 0.0262 | 2.625 | 21.000 |
| Sodium Chloride | Filler | 15.200 | 0.114 | 0.0114 | 1.140 | 9.120 |
| Herbal Fragrance | Perfume | 0.100 | $7.50 \times 10^{-4}$ | $7.50 \times 10^{-5}$ | $7.50 \times 10^{-3}$ | 0.0600 |
| Water | | | 99.2505 | 99.9250 | 92.5000 | 40.0000 |
| Total Solids | | 100% | 0.7495 | 0.0750 | 7.5000 | 60.0000 |
| pH | | | 2.95 | 3.93 | 2.48 | 1.16 |

(a) Sodium dodecylbenzene sulfonate: 20.0%
Coconut fatty acid monoethanolamide: 12.0%
Ethoxylated (avg. 9.5 mole EO) nonylphenol: 3.0%

(D)
MAINTENANCE CLEANER LIQUID

| INGREDIENTS | GROUP | W/W % CONC. | USE CONCENTRATIONS - W/W% NORMAL 0.75% | LOW LIMIT 0.12% | HIGH LIMIT MAINTENANCE 7.5% | High Limit Stripping 60% |
|---|---|---|---|---|---|---|
| Citric Acid | Weaker Acid | 8.503 | 0.0638 | 0.0102 | 0.638 | 5.102 |
| Phosphoric Acid | Stronger Acid | 1.908 | 0.0143 | $2.29 \times 10^{-3}$ | 0.143 | 1.145 |
| Monosodium Phosphate | Buffer | 13.333 | 0.100 | 0.0160 | 1.000 | 8.000 |
| Sodium Xylene Sulfonate | Hydrotrope | 10.748 | 0.0806 | 0.0129 | 0.806 | 6.449 |
| Dodecylbenzene Sulfonic Acid | Surfactant | 18.322 | 0.137 | 0.0220 | 1.374 | 10.993 |
| Ethoxylated Nonylphenol (9.5 mole EO) | Surfactant | 2.880 | 0.0216 | $3.46 \times 10^{-3}$ | 0.216 | 1.728 |
| Triethanolamine | Neutralizer | 5.646 | 0.0423 | $6.78 \times 10^{-3}$ | 0.423 | 3.388 |
| Sodium Hydroxide | Neutralizer | 1.133 | $8.50 \times 10^{-3}$ | $1.36 \times 10^{-3}$ | 0.0850 | 0.680 |
| Sodium Chloride | Filler | 0.839 | $6.29 \times 10^{-3}$ | $1.01 \times 10^{-3}$ | 0.0629 | 0.503 |
| Coconut Fatty Acid Alkanolamide | Foam Stabilizer | 1.723 | 0.0129 | $2.07 \times 10^{-3}$ | 0.129 | 1.034 |
| Isopropyl Alcohol | Solvent | 1.995 | 0.0150 | $2.39 \times 10^{-3}$ | 0.150 | 1.197 |
| Herbal Fragrance | Perfume | 0.113 | $8.47 \times 10^{-4}$ | $1.36 \times 10^{-4}$ | $8.47 \times 10^{-3}$ | 0.0678 |
| Phthalocyanine-Anthraquinone Dye | Dye | $7.10 \times 10^{-4}$ | $5.32 \times 10^{-6}$ | $8.52 \times 10^{-7}$ | $5.32 \times 10^{-5}$ | $4.26 \times 10^{-4}$ |
| Water | | 32.856 | 99.497 | 99.919 | 94.9646 | 59.7138 |
| TOTAL SOLIDS | | 67.144 | 0.503 | 0.0806 | 5.0354 | 40.287 |
| pH | | 2.32 | 3.15 | 4.05 | 2.8 | 2.57 |

What is claimed is:

1. A buffered composition which is (A) useful for removing unwanted film of essentially animal or vegetable origin from flooring and/or for maintaining said flooring free of such film and (B) safe for non-professional users and for flooring materials, comprising on a parts by weight, dry basis:

(a) 1 to 60 parts of at least one first component being an acid or salt thereof, said first component acid having a pK value of greater than 2.8 at 25° C.

(b) 0.1–15 parts of at least one second component being an acid selected from the group consisting of sulfamic acid, phosphoric acid, maleic acid, sodium bisulfate, sodium bisulfite, an organic sulfonic acid, an organic phosphonic acid, an organic ester of sulfuric acid and an organic ester of phosphoric acid, with the provision that at least one of (a) and (b) provides free acid;

(c) sufficient but not more than 80 parts of a buffering salt of a weak acid selected from the group consisting of sodium acid pyrophosphate, monosodium phosphate, sodium acetate, and sodium citrate for maintaining an aqueous solution of said composition at a pH in the range of about 1 to about 4.1;

(d) 0 to 10 parts of hydrotrope selected from the group consisting of sodium alkylnaphthalene sulfonate and sodium xylene sulfonate; and (e) 0 to 40 parts of a surfactant that is the same as or different from said second component (b);

wherein the ratio of total acid to free acid of said composition is at least 2.5, and wherein said composition is essentially free of hydrofluoric and glutaric acids.

2. A composition of claim 1 wherein component (a) is citric acid, isocitric acid, tartaric acid, malic acid, monohydroxyacetic acid, acetic acid or gluconic acid.

3. A composition of claim 1 wherein component (b) comprises sulfamic acid or phosphoric acid.

4. A composition of claim 1 wherein the ratio of total acid to free acid is at least over 3.

5. A maintenance/cleaner composition, useful for maintaining ceramic tile flooring free of film of animal or vegetable origin, comprising a composition of claim 1 wherein:

(a) is 5 to 30 parts of citric acid;

(b) is 0.1 to 10 parts of sulfamic and/or phosphoric acid;

(c) is 2 to 50 parts of monosodium phosphate and/or sodium acid pyrophosphate;

(d) is 0 to 10 parts of hydrotrope;
(e) is 5 to 40 parts of nonionic and/or anionic surfactant;
(f) is 0 to 10 parts of fumed silica ;
(g) is 0 to 15 parts of sodium tripolyphosphate; and
(h) is 0 to 50 parts of filler:

6. A composition of claim 5, wherein (h) is sodium chloride and/or sodium sulfate.

7. A composition of claim 5, in powder form, comprising on a weight percent basis:
(a) 10–20% citric acid;
(b) 0.1–1.5% of sulfamic and/or phosphoric acid;
(c) 20–45% of sodium acid pyrophosphate;
(d) 0.3–1.0% sodium alkyl naphthalene sulfonate;
(e) 30–40% of a mixture of nonionic and anionic surfactants;
(f) 0.3–1.0% fumed silica;
(g) 10–20% sodium chloride.

8. A maintenance/cleaner composition according to claim 5, in liquid form, comprising on a weight percent basis, a composition of:
(a) 6–10% citric acid;
(b) 1.5–2.5% phosphoric acid;
(c) 8–18% monosodium phosphate;
(d) 6–13% hydrotrope;
(e) 16–35% of a mixture of anionic and nonionic surfactants;
(f) 0.6–1.1% of filler;
(g) 2–11% of neutralizer;
(h) 1.3–2.2% of foam stabilizer;
(i) 1.5–2.5% of solvent;
(j) 25–40% of water.

9. A maintenance additive composition, useful for maintaining ceramic tile flooring free of unwanted film, comprising a composition of claim 1, wherein;
(a) is 1 to 60 parts of citric acid;
(b) is 0.1 to 10 parts of sulfamic acid and/or phosphoric acid;
(c) is 0.1 to 80 parts of monosodium phosphate and/or sodium acid pyrophosphate;
(d) is 0 to 10 parts of hydrotrope;
(e) is 0 to 15 parts of nonionic and/or anionic surfactant;
(f) is 0 to 10 parts of fumed silica ;
(g) is 0 to 15 parts of sodium tripolyphosphate;
(h) is 0 to 50 parts of filler.

10. A maintenance additive composition in accordance with claim 9, in powder form, said composition on a weight percent basis, comprising:
(a) 25–35% citric acid;
(b) 3–5% of sulfamic and/or phosphoric acid;
(c) 20–66% of monosodium phosphate and/or sodium acid pyrophosphate;
(d) 0.2–1.0% of hydrotrope;
(e) 0.3–1.0% fumed silica;
(f) 0.5–2.0% sodium tripolyphosphate; and
(g) 5–15% filler.

11. A stripper composition, useful for removing unwanted film from ceramic tile flooring, comprising a composition of claim 1, wherein:
(a) is 4 to 60 parts of citric acid;
(b) is 0.1 to 15 parts of sulfamic acid and/or phosphoric acid;
(c) is 0.1 to 40 parts of monosodium phosphate and/or sodium acid pyrophosphate;
(d) is 0 to 10 parts of hydrotrope;
(e) is 0 to 30 parts of nonionic and/or anionic surfactant;
(f) is 0 to 10 parts of fumed silica;
(g) is 0 to 15 parts of sodium tripolyphosphate;
(h) is 0 to 50 parts of filler;
(i) is 0 to 5 parts of neutralizer; and
(j) is 0 to 10 parts of foam stabilizer.

12. A stripper composition according to claim 11, in powder form, said composition on a weight percent basis comprising:
(a) 25–35% citric acid;
(b) 3–5% of sulfamic and/or phosphoric acid;
(c) 20–64% of a mixture of monosodium phosphate and sodium acid pyrophosphate;
(d) 0.2–1% of sodium alkyl naphthalene sulfonate;
(e) 1.5–3% of a nonionic surfactant;
(f) 0.3–1.0% fumed silica;
(g) 0.5–2% of sodium tripolyphosphate; and
(h) 5–15% of filler.

13. A stripper composition in liquid form, according to claim 11, said composition comprising:
(a) 10–15 parts citric acid;
(b) 0.1–2.5 parts sulfamic and/or phosphoric acid;
(c) 15–25 parts of a mixture of monosodium phosphate and sodium acid pyrophosphate;
(d) 3.5–6 parts of 40% by weight sodium xylene sulfonate;
(e) 0.5–2.0 parts surfactant;
(f) 0.1–1 parts of sodium tripolyphosphate; and
(g) 2–6 parts by weight of filler.

14. A one-step stripper composition in liquid form, according to claim 11, said composition comprising:
(a) 4–20 parts citric acid,
(b) 0.7–3 parts phosphoric acid,
(c) 8–32 parts buffering salt of a weak acid,
(d) 2–9 parts hydrotrope,
(e) 1–15 parts surfactant,
(f) 1–8 parts filler,
(g) 0.6–3 parts neutralizer, and
(h) 0.8–3.5 parts foam stabilizer.

15. A ready-to-use stripper composition consisting essentially of a composition according to claim 11 and sufficient water of dilution to yield a pH of 1.9–2.8.

16. A ready-to-use, one-step stripper composition consisting essentially of a composition according to claim 14 and sufficient water of dilution to yield a pH of about 2.2–2.8.

17. A ready-to-use maintenance cleaner solution consisting essentially of a composition according to claim 5 and sufficient water to yield a pH of about 2.7–4.1.

18. A composition, useful for removing unwanted film from ceramic tile flooring and/or for maintaining said flooring in a film-free state, consisting essentially of a combination of an aqueous surfactant/detergent solution and a composition of claim 9.

19. A composition according to claim 18, said surfactant/detergent solution comprising:
(a) from 2 to 50% of surfactant selected from the group consisting of linear alkylbenzene sulfonate, sodium laurylether sulfate, sodium alpha olefin sulfonate, and sodium lauryl sulfate;
(b) 2 to 25% of a member selected from the group consisting of coconut fatty acid alkanolamide, and lauryl dimethylamineoxide;
(c) 2 to 50% of nonionic surfactant selected from the group consisting of ethoxylated alkylphenol, modified ethoxylated and/or propoxylated straight-chain alcohol;
(d) 0 to 10% of a sequestering agent selected from the group consisting of tetrasodium ethylenediaminetetraacetate, sodium gluconate, sodium glucoheptonate, sodium citrate, and trisodium N-hydroxyethylenediaminetriacetate;

all percentages being by weight and based on the total weight of all components.

20. A buffered composition which (A) is useful for removing unwanted film of essentially animal or vegetable origin from flooring and/or for maintaining said flooring free of such film, (B) is safe for non-professional users and for flooring materials, and (C) comprises on a parts by weight, dry basis:

(a) 1 to 60 parts of at least one first component being an acid or salt thereof, said first component acid having a pK value of greater than 2.8 at 25° C.;

(b) 0.1–15 parts of at least one second component being an acid selected from the group consisting of sulfamic acid, phosphoric acid, maleic acid, sodium bisulfate, sodium bisulfite, an organic sulfonic acid, an organic phosphonic acid, an organic ester of sulfuric acid and an organic ester of phosphoric acid;

(c) sufficient but not more than 80 parts of a buffering salt of a weak acid selected from the group consisting of sodium acid pyrophosphate, monosodium phosphate, sodium acetate and sodium citrate for maintaining an aqueous solution of said composition at a pH in the range of about 1 to about 4.1;

wherein the ratio of total acid to free acid of said composition is at least 2.5, and wherein said composition is essentially free of hydrofluoric and glutaric acids.

21. A composition of claim 20, wherein the ratio of total acid to free acid is at least 3.

22. A composition of claim 20, wherein the ratio of total acid to free acid is at least 4.

23. A buffered composition which is (A) useful for removing unwanted film of essentially animal or vegetable origin from flooring and/or for maintaining said flooring free of such film and (B) safe for non-professional users and for flooring materials, comprising on a parts by weight, dry basis:

(a) 1 to 60 parts of at least one first component being an acid or salt therof, said first component acid having a pK value of greater than 2.8 at 25° C., (b) 0.1–15 parts of at least one second component being an acid selected from the group consisting of sulfamic acid, phosphoric acid, maleic acid, sodium bisulfate, sodium bisulfite, an organic sulfonic acid, an organic phosphonic acid, an organic ester of sulfuric acid and an organic ester of phosphoric acid, with the provision that at least one of (a) and (b) provides free acid;

(c) sufficient but not more than 80 parts of a buffering salt of a weak acid selected from the group consisting of sodium acid pyrophosphate, monosodium phosphate, sodium acetate, and sodium citrate for maintaining an aqueous solution of said composition at a pH in the range of about 1 to about 4.1;

(d) 0 to 10 parts of hydrotrope selected from the group consisting of sodium alkylnaphthalene sulfonate and sodium xylene sulfonate; and (e) 0 to 40 parts of a surfactant that is different from said second component (b);

wherein the ratio of total acid to free acid of said composition is at least 2.5, and wherein said composition is essentially free of hydrofluoric and glutaric acids.

24. A buffered composition which is (A) useful for removing unwanted film of essentially animal or vegetable origin from flooring and/or for maintaining said flooring free of such film and (B) safe for non-professional users and for flooring materials, comprising on a parts by weight, dry basis:

(a) 1 to 60 parts of at least one first component being an acid or salt thereof, said first component acid having a pK value of greater than 2.8 at 25° C., (b) 0.1–15 parts of at least one second component being an acid selected from the group consisting of sulfamic acid, phosphoric acid, maleic acid, sodium bisulfate, sodium bisulfite, an organic phosphonic acid, an organic ester of sulfuric acid and an organic ester of phosphoric acid, with the provision that at least one of (a) and (b) provides free acid;

(c) sufficient but not more than 80 parts of a buffering salt of a weak acid selected from the group consisting of sodium acid pyrophosphate, monosodium phosphate, sodium acetate, and sodium citrate for maintaining an aqueous solution of said composition at a pH in the range of about 1 to about 4.1;

(d) 0 to 10 parts of hydrotrope selected from the group consisting of sodium alkylnaphthalene sulfonate and sodium xylene sulfonate; and (e) 0 to 40 parts of a surfactant that is different from said second component (b);

wherein the ratio of total acid to free acid of said composition is at least 2.5, and wherein said composition is essentially free of hydrofluoric and glutaric acids.

* * * * *

UNITED STATES PATENT AND TRADEMARK OFFICE

CERTIFICATE OF CORRECTION

PATENT NO. : 4,749,508

DATED : June 7, 1988

INVENTOR(S) : John R. Cockrell, Jr., et al.

It is certified that error appears in the above-identified patent and that said Letters Patent is hereby corrected as shown below:

Column 3, delete Formula 1 and insert the following formula:

FORMULA 1: POLYMERIZED GREASE FILM MOLECULAR MODEL

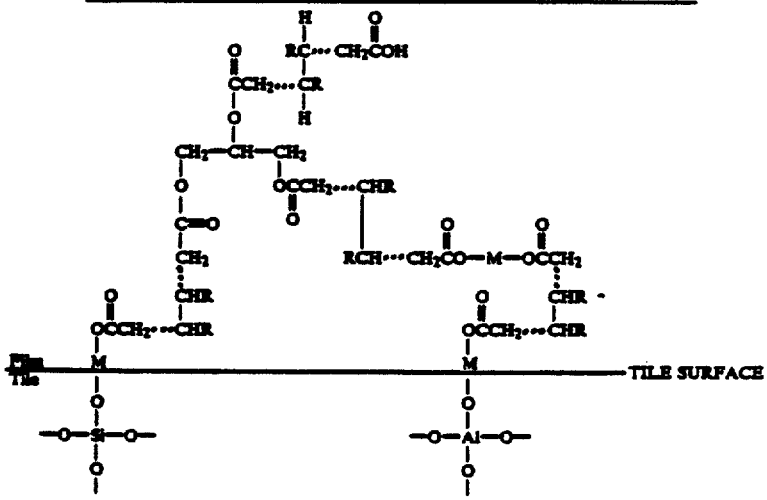

Signed and Sealed this

Twenty-seventh Day of September, 1988

*Attest:*

DONALD J. QUIGG

*Attesting Officer*

*Commissioner of Patents and Trademarks*